US007142559B2

(12) United States Patent
Choi et al.

(10) Patent No.: US 7,142,559 B2
(45) Date of Patent: Nov. 28, 2006

(54) PACKET CONVERTING APPARATUS AND METHOD THEREFOR

(75) Inventors: Yong Soo Choi, Kwangmyong-shi (KR); Tae Ik Kang, Anyang-shi (KR)

(73) Assignee: LG Electronics Inc., Seoul (KR)

( * ) Notice: Subject to any disclaimer, the term of this patent is extended or adjusted under 35 U.S.C. 154(b) by 947 days.

(21) Appl. No.: 09/968,071

(22) Filed: Oct. 1, 2001

(65) Prior Publication Data

US 2002/0196762 A1 Dec. 26, 2002

(30) Foreign Application Priority Data

Jul. 23, 2001 (KR) ..... 2001-44253

(51) Int. Cl.
*G10L 19/14* (2006.01)

(52) U.S. Cl. ..... 370/466; 370/497; 704/500

(58) Field of Classification Search ..... 370/338, 370/229; 704/202, 207–208, 219, 230
See application file for complete search history.

(56) References Cited

U.S. PATENT DOCUMENTS 5,751,903 A * 5/1998 Swaminathan et al. ..... 704/230
5,995,923 A * 11/1999 Mermelstein et al. ..... 704/219
2003/0009325 A1* 1/2003 Kirchherr et al. ..... 704/211
2003/0028386 A1* 2/2003 Zinser et al. ..... 704/500

* cited by examiner

*Primary Examiner*—Hassan Kizou
*Assistant Examiner*—Salman Ahmed
(74) *Attorney, Agent, or Firm*—Lee, Hong, Degerman, Kang & Schmadeka

(57) ABSTRACT

A packet converting apparatus and method is disclosed, in which audio packet data of various types used in cable/radio networks can effectively be converted. The packet converting apparatus includes a bit unpacking unit for bit unpacking first type packet data, a parameter inverse quantization unit for inverse quantizing the unpacked data to obtain a main parameter of the first type packet data, a parameter converter for converting the obtained main parameter to a parameter of second type packet data through inter-frame interpolation, a quantization unit for quantizing the second type parameter converted by the parameter converter, and a bit packing unit for bit packing the quantized data to reassemble the bit packed data to second type packet data and output the second type packet data to a destination.

18 Claims, 13 Drawing Sheets

PACKET CONVERTING APPARATUS AND METHOD THEREFOR

CROSS REFERENCE TO RELATED ART

This application claims the benefit of Korean Patent Application No. 2001-44253, filed on Jul. 23, 2001, which is hereby incorporated by reference.

BACKGROUND OF THE INVENTION

1. Field of the Invention

The present invention relates to a packet converting apparatus and method, and more particularly, to a packet converting apparatus and method that converts the data packet of various types used in communication networks.

2. Description of the Related Art

For efficient communication of an audio signal, a transmitter part converts an analog audio signal to a digital signal and compresses the digital signal through a vocoder. A receiver decodes the compressed digital signal to restore audio and again converts the audio signal to the analog signal. Such a function is implemented by the vocoder. The vocoder has been developed in various aspects according to purpose of use and field of application services. The vocoder is also used for storage, such as a voice inbox and for communication.

A related art packet converting apparatus and method in communication systems using different vocoders is shown in FIG. 1 which illustrates a general cable/radio communication network.

The cable/radio communication network, as shown in FIG. 1, includes a mobile network 50, a public switched telephone network (PSTN) 60, and an Internet protocol (IP) network 70.

In communication based on the mobile network 50, EVRC/AMR 10 protocal, such as IS-127, v8 Kbps EVRC, GSM v12 Kbps AMR, IS-96 v8 Kbps QCELP, IS-733 v13 Kbps QCELP, and GSM 13 Kbps FER, are used. In communication based on the PSTN 60, G.711(PCM) 20 and 32 Kbps G.726 are used. In communication based on the IP network 70, 6.3/5.3 Kbps G.723.1 and 8 Kbps G729 30 are used.

Therefore, an apparatus for converting an audio packet of different types is required between communication systems using different vocoders. Such media conversion is implemented through a media gateway 40 shown in FIG. 1.

FIGS. 2 and 3 are block diagrams of a related art packet converting apparatus (media gateway) for describing a related art packet converting method. In FIG. 2, a tandem encoding method is used as a packet converting method. In the tandem encoding method, a packet of a first type encoder 80 received through a first network 90 is decoded by a first type decoder 41 of the media gateway 40 so that a PCM signal is obtained. The PCM signal is again encoded by a second type encoder 44 to obtain a desired packet. For example, the decoded PCM signal is analyzed by the second type encoder 44 to obtain encoded parameters. The encoded parameters are then quantized and packed so that the packet data is transmitted to a second type decoder 110 of the receiving party through a second network 100.

FIG. 3 illustrates the reverse of FIG. 2, and thus the description will be omitted.

FIGS. 4 and 5 illustrate a related art packet converting method. FIG. 4 illustrates a tandem coding method in which Packet-A of the first type decoder 41, received in the media gateway 40, is converted to a second type packet in the encoder 44.

Referring to FIG. 4, an audio packet of the first type encoder 80, input through the first network 90, is bit-unpacked in the first type decoder 41 (S10). Subsequently, the unpacked data is inverse quantized so that an audio parameter of the first type encoder 80 is obtained (S11). PCM type audio signals are synthesized using the audio parameter (S12). Then, the first type decoder 41 transmits the PCM audio signals to the second type encoder 44, and the second type encoder 44 analyzes the received PCM signals to obtain an audio parameter of the second type packet (S13). The audio parameter of the second type packet is then quantized (S14). The quantized data is bit-packed so that a second type audio packet is output to the second type decoder 110 through a second network 100 (S15).

FIG. 5 illustrates a tandem coding method in which a packet Packet-B of the second type decoder 46, received in the media gateway 40, is converted to a packet of the first type encoder 47. Referring to FIG. 5, an audio packet of the second type encoder 130, input through the second network 100, is bit-unpacked in the second type decoder 46(S20). Subsequently, the unpacked data is inverse quantized so that an audio parameter of the second type encoder 110 is obtained (S21). PCM type audio signals are synthesized using the audio parameter (S22). Then, the second type decoder 46 transmits the PCM audio signals to the first type encoder 47, and the first type encoder 47 analyzes the received PCM signals to obtain an audio parameter of the first type packet (S23). The audio parameter of the first type packet is then quantized (S24). The quantized data is bit-packed so that a first type audio packet is output to the first type decoder 140 through the first network 90 (S25).

The aforementioned related art packet converting apparatus and method has several problems. After the PCM signals are generated inside the media gateway, complicated steps are performed in such a manner that the parameter is analyzed and quantized using the PCM signals as input signals of a desired encoder. Such steps increase signal processing time and quantity. For parameter analysis, a delay corresponding to a frame length of the encoder, including lookahead delay additionally occurs. Such problems constrain the number of channels of a multi-channel real time packet converting apparatus in the media gateway. This constrains the number of subscribers to the mobile network and the IP network.

SUMMARY OF THE INVENTION

Accordingly, the present invention is directed to a packet converting apparatus and method that substantially obviates one or more of the problems due to limitations and disadvantages of the related art.

An object of the present invention is to provide a packet converting apparatus and method in which audio packet data of various types used in cable/radio networks can effectively be converted.

Additional features and advantages of the invention will be set forth in the description that follows, and in part will be apparent from the description, or may be learned by practice of the invention. The objectives and other advantages of the invention will be realized and attained by the scheme particularly pointed out in the written description and claims hereof as well as the appended drawings.

To achieve these and other advantages in accordance with the present invention, as embodied and broadly described, a packet converting apparatus for converting a first type packet data to a second type packet data, comprises a bit unpacking unit for bit unpacking the first type packet data; a parameter inverse quantization unit for inverse quantizing unpacked data to obtain a first parameter of the first type packet data; a parameter converter for converting the first parameter to a second parameter of the second type packet data using inter-frame interpolation; a quantization unit for quantizing the second parameter converted by the parameter converter and outputting a second type quantized data; and a bit packing unit for bit packing the second type quantized data to the second type packet data.

According to one aspect of the present invention, the packet converting apparatus further includes a packet conversion determining unit for detecting a destination packet type of the first type packet data and determining that the first type packet data is converted to the second type packet data.

According to another aspect of the present invention, the first and the second type packet data are at least one of audio packet data, video packet data, and audio/video packet data.

According to another aspect of the present invention, the first parameter includes at least one of a line spectrum pair, pitch, adaptive codebook (ACB) gain, ACB index, fixed codebook (FCB) gain and FCB index. Preferably, the inter-frame interpolation in the parameter converter smoothes and scales the line spectrum pair of the first parameter to obtain a line spectrum pair of the second parameter; smoothes the pitch of the first parameter to obtain a pitch of the second parameter; constrains a search range in response to the ACB gain and the ACB index and searches the search range to obtain values corresponding to the ACB gain and the ACB index of the first parameter and converts the values into an ACB gain and an ACB index of the second parameter; and searches to obtain values corresponding to the FCB gain and the FCB index of the first parameter and converts the values into an FCB gain and an FCB index of the second parameter.

In another aspect of the present invention, a method for converting a first type packet data to a second type packet data comprises the steps of bit unpacking the first type packet data; inverse quantizing unpacked data to obtain a first parameter of the first type packet data; converting the first parameter to a second parameter of the second type packet data using inter-frame interpolation; quantizing the second parameter and outputting a second type quantized data; and bit packing the second type quantized data to the second type packet data.

According to one aspect of the present invention, the step of inter-frame interpolation includes smoothing and scaling the line spectrum pair of the first parameter to obtain a line spectrum pair of the second parameter; smoothing the pitch of the first parameter to obtain a pitch of the second parameter; constraining a search range in response to the ACB gain and the ACB index and searching the search range to obtain values corresponding to the ACB gain and the ACB index of the first parameter and converting the values into an ACB gain and an ACB index of the second parameter; and searching to obtain values corresponding to the FCB gain and the FCB index of the first parameter and converting the values into an FCB gain and an FCB index of the second parameter.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and, together with the description, serve to explain the principles of the invention. In the drawings.

DETAILED DESCRIPTION OF THE PREFERRED EMBODIMENTS

Reference will now be made in detail to the preferred embodiments of the present invention, examples of which are illustrated in the accompanying drawings.

Figure 1:
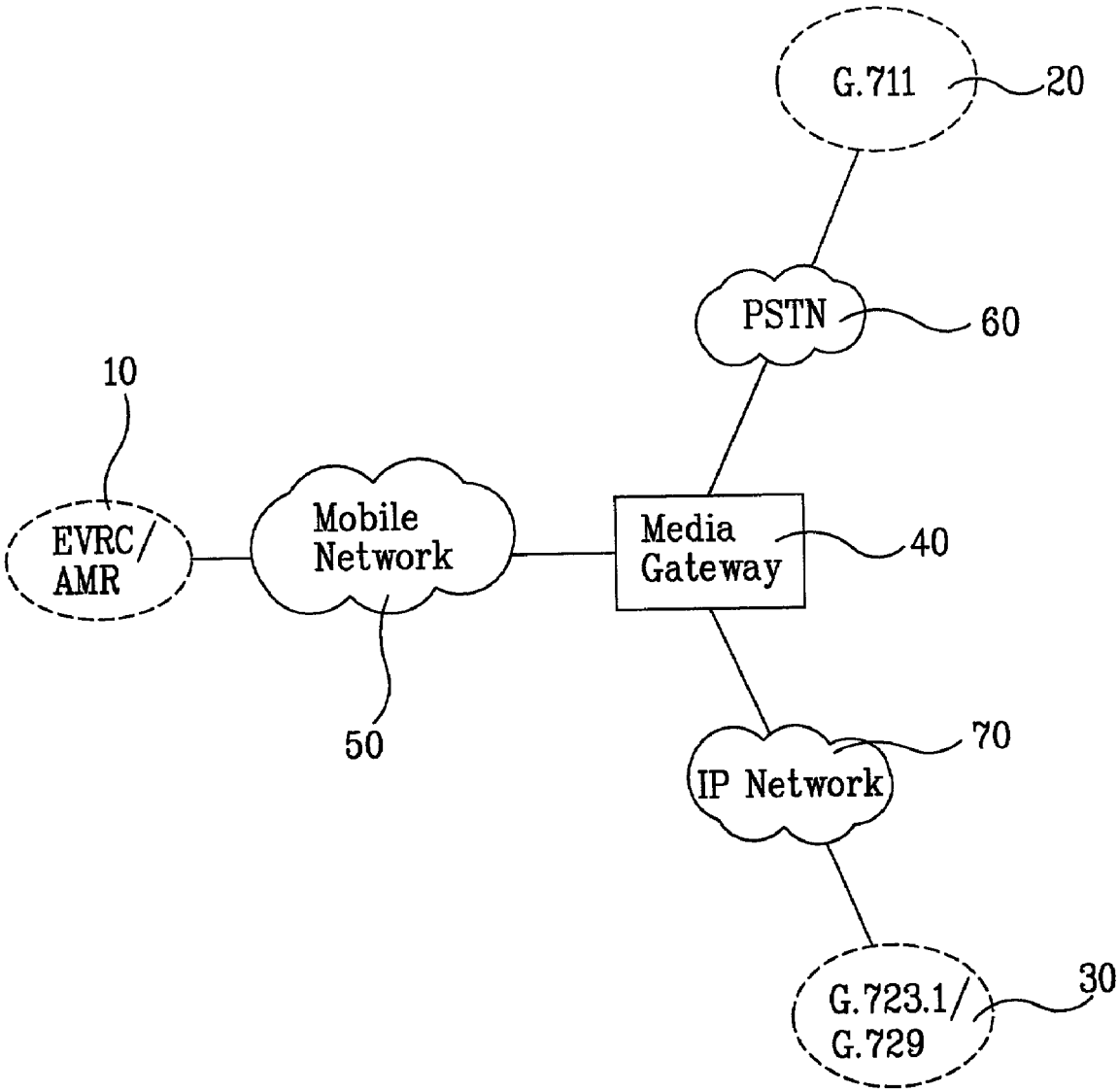
FIG.1 Related Art
FIG. 1 illustrates a general cable/radio communication network.
Figure 2:
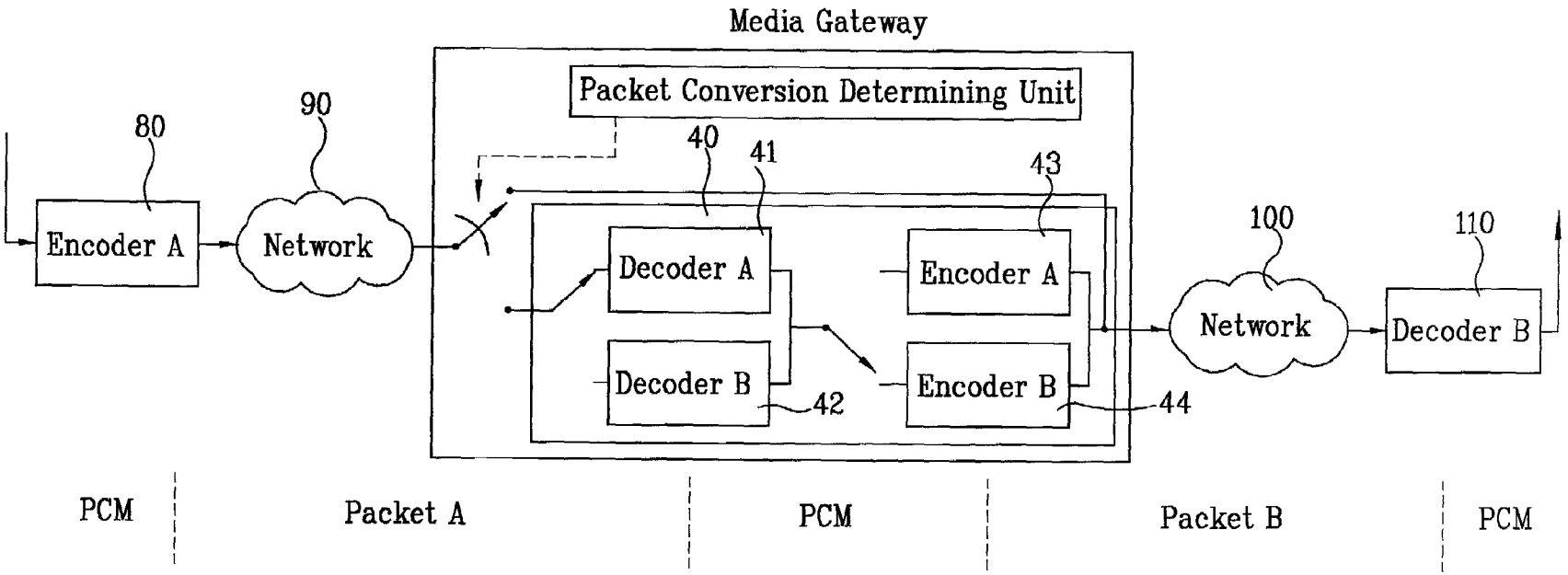
FIG.2 Related Art
FIGS. 2 and 3 are block diagrams of a related art packet converting apparatus for describing a related art packet converting method.
Figure 3:
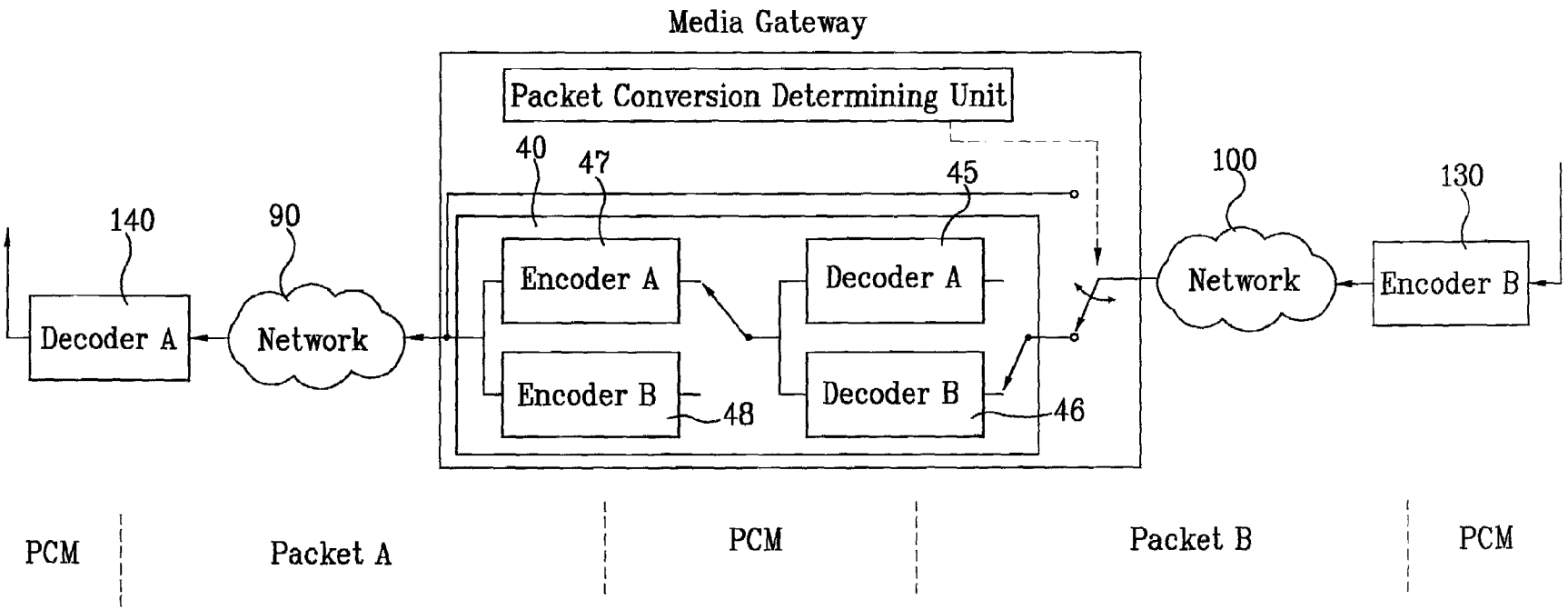
FIG.3 Related Art
Figure 4:
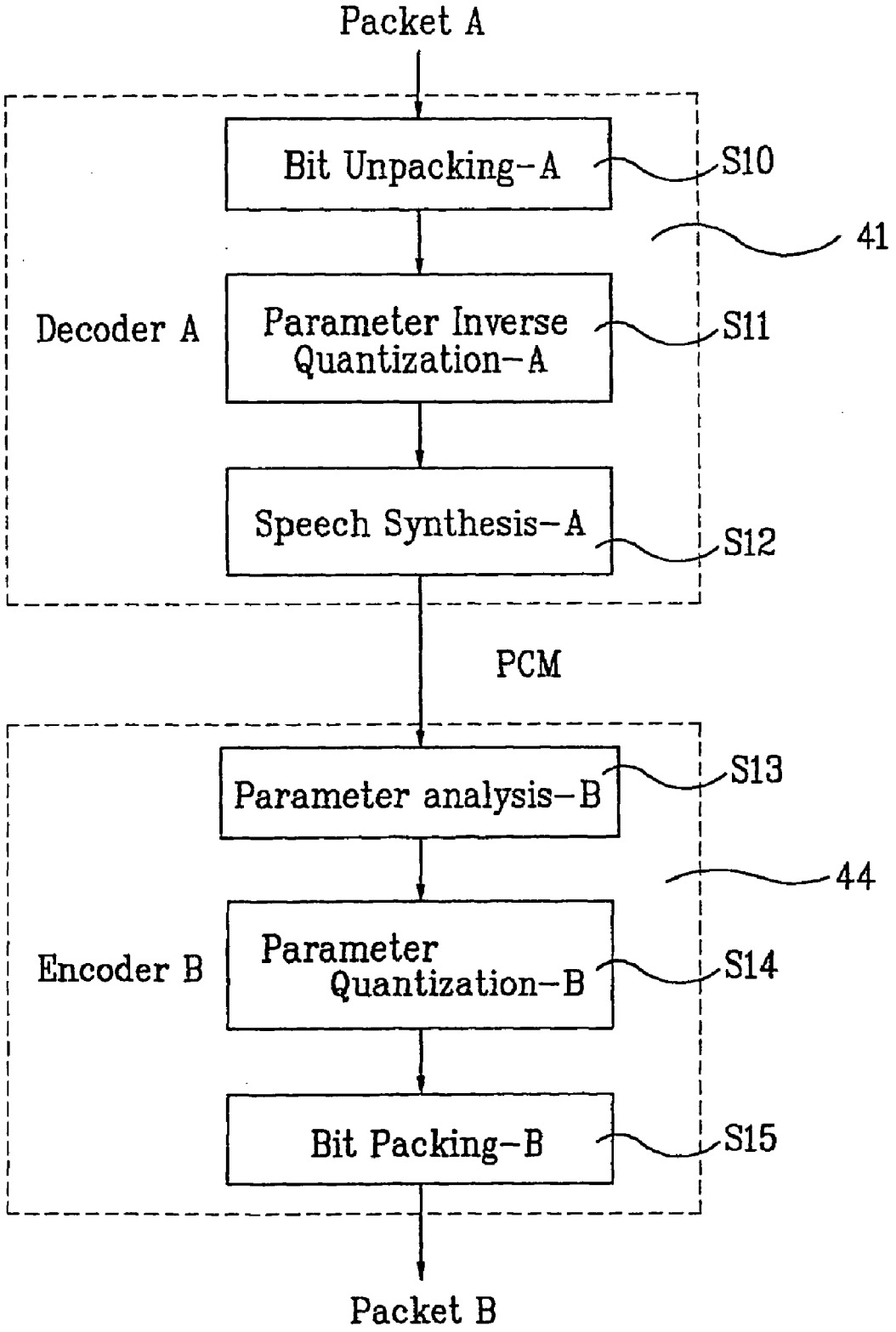
FIG. 4 Related Art
FIGS. 4 and 5 illustrate a related art packet converting method.
Figure 5:
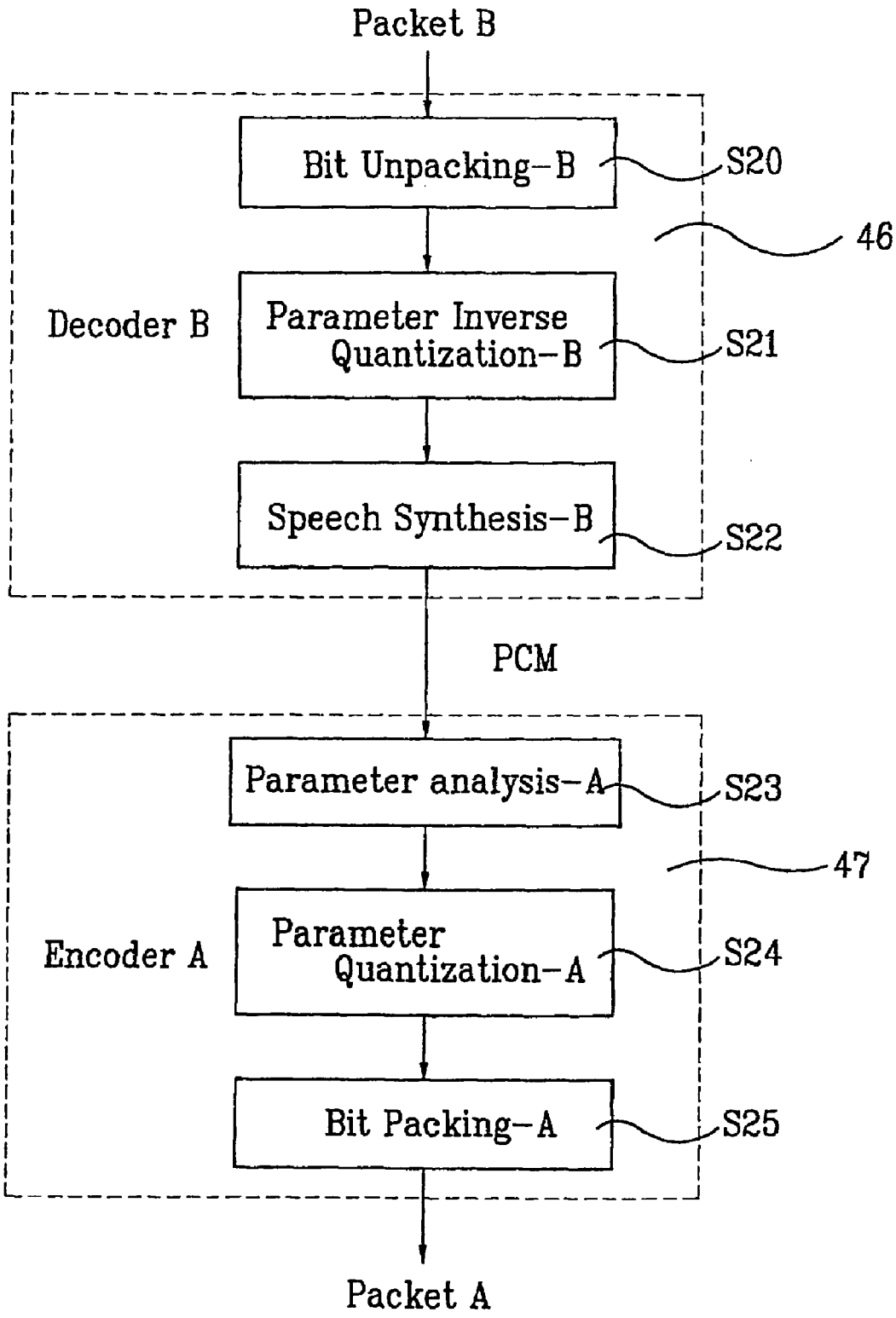
FIG.5 Related Art
Figure 6:
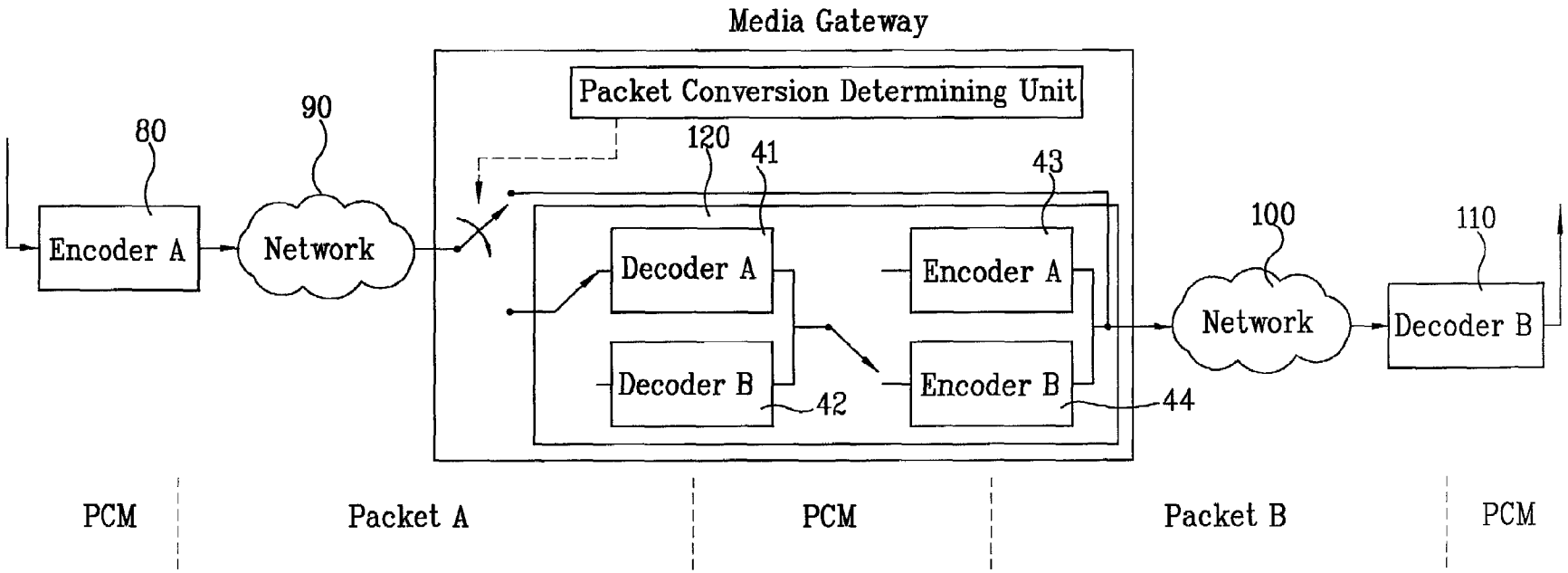
FIGS. 6 and 7 are block diagrams illustrating a packet converting apparatus according to a preferred embodiment of the present invention.
Figure 7:
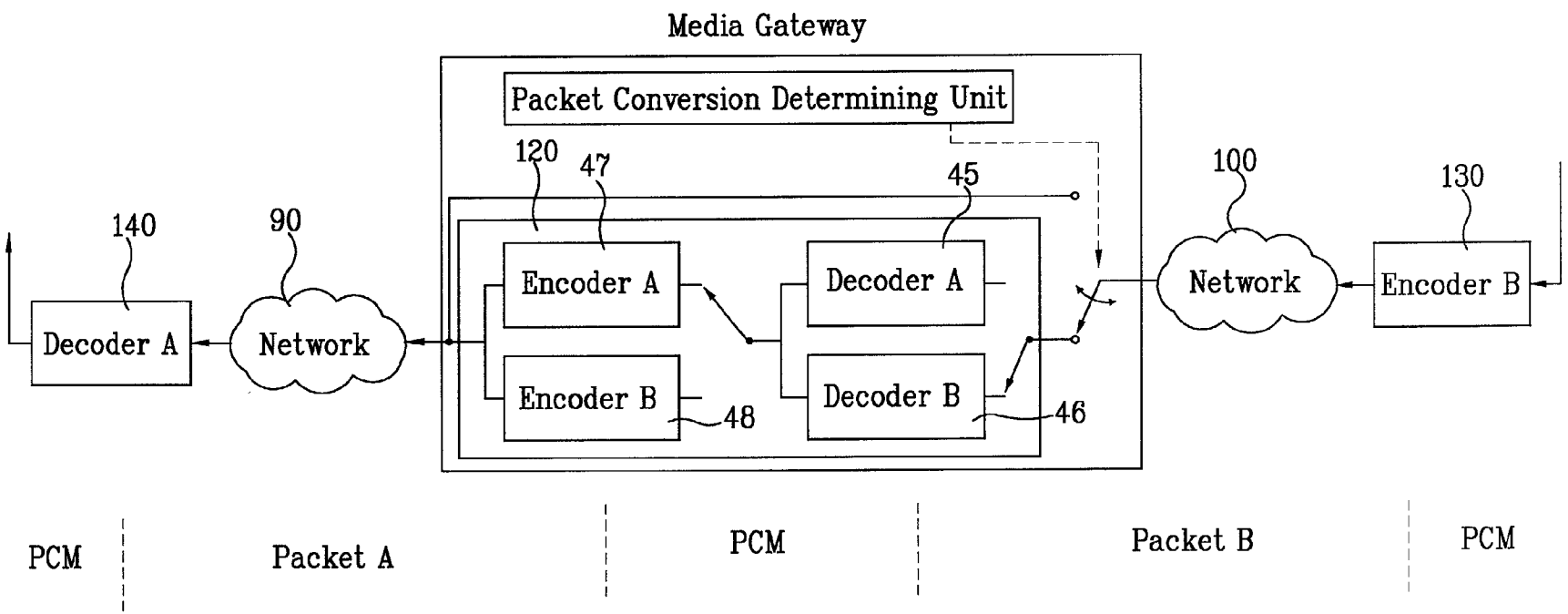

FIGS. 6 and 7 are block diagrams illustrating a packet converting apparatus according to a preferred embodiment of the present invention. The tandem encoding used in the related art packet converting apparatus is not used in the preferred embodiment. In the present invention, a first type parameter data is directly extracted from a packet of an encoder, received through a communication network, and is converted to a second type parameter. After the converted parameter is quantized and packed, the packet data is transmitted to a receiving party through the communication network.

Referring to FIG. 6, a first transcoder 121 of a media gateway 120 receives a first type packet of a first type encoder 80, received through a first communication network 90, and extracts parameter data of the first type packet and directly converts the extracted parameter data to parameter data of a second type packet. The second type packet is then quantized and packed so that the second type packet is reassembled and then transmitted to a second type decoder 110 through a second communication network 100. The transcoders 121 and 122 inside the media gateway 120 of such a packet converting apparatus will be described with reference to FIGS. 10 and 11.

The media gateway 120 according to the preferred embodiment of the present invention detects a destination packet type from an input packet and bypasses the destination packet type if the input packet type is equal to the destination packet type. If the input packet type is not the same as the destination packet type, the media gateway 120 may further include a packet conversion determining unit which converts a packet type to conform to the destination packet type.

FIG. 7 illustrates a transmitting party and a receiving party switched with those of FIG. 6. Since the processing steps are the same as shown in FIG. 6, they will not be repeated.

Figure 8:
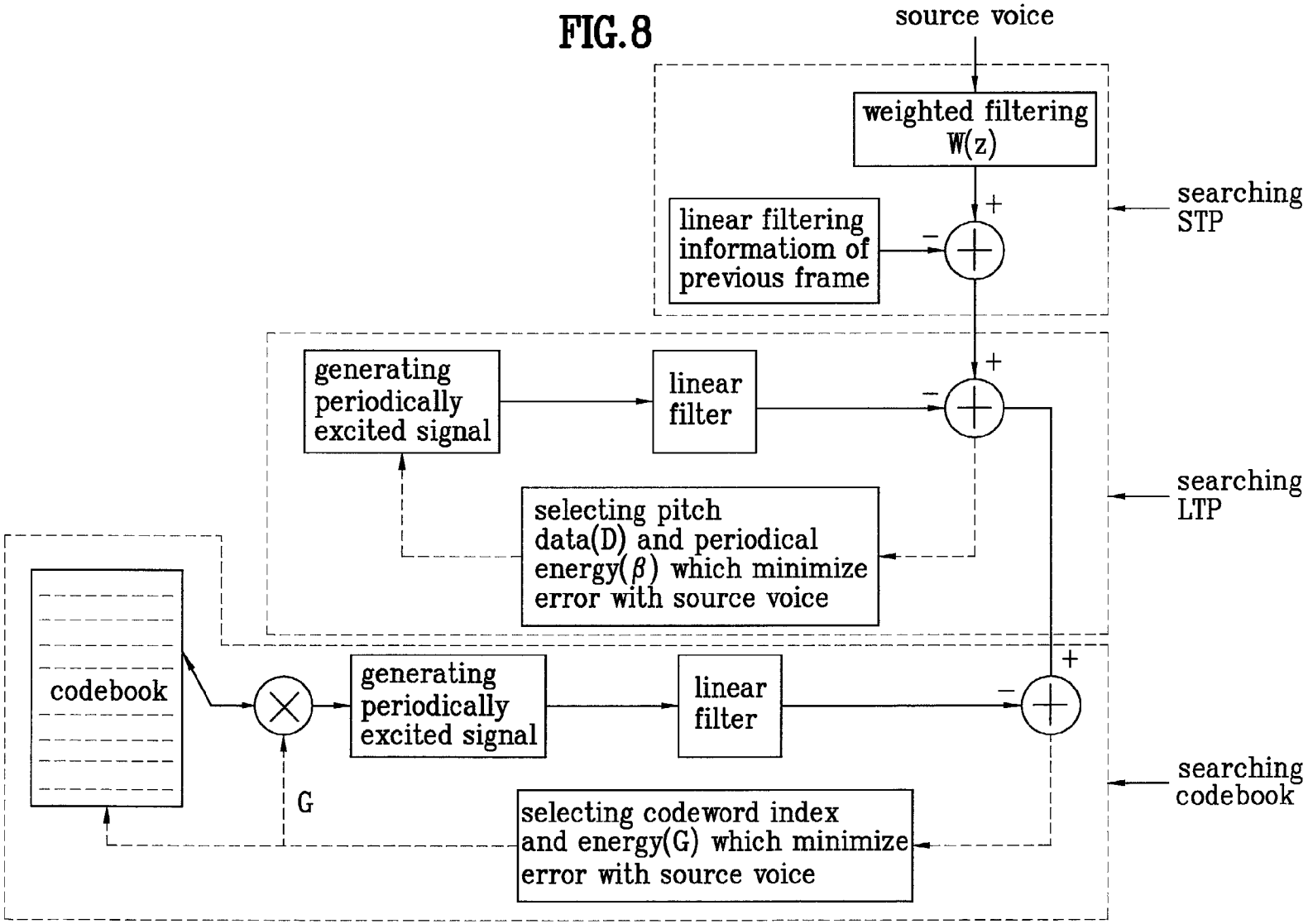
FIG. 8 illustrates a structure of a codebook excited linear prediction (CELP) audio encoder.

FIG. 8 illustrates a structure of a codebook excited linear prediction (CELP) audio encoder. The CELP audio encoder is an algorithm commonly used among audio encoders based on synthetic analysis. The CELP audio encoder regards an excited signal as a vector, and uses a method for selecting an excited signal vector that can minimize error with a source voice from a codebook. This method is based on the spectrum envelope data and pitch data which are removed from a source voice signal. A remaining signal is shown in a white noise type. Therefore, a codebook having different white noises as code vectors is prepared in advance and pitch data and spectrum envelope data are added to one of the white noises to generate a synthetic sound, and parameters that minimize error with a source voice are selected.

The CELP audio encoder includes a short term prediction (STP) step for obtaining spectrum envelope data, a long term prediction (LTP) search step for predicting a parameter corresponding to a pitch period, and a code book search step for minimizing errors.

Standard audio encoders, such as G.723.1, G.729, EVRC, QCELP, GSAM-AMR, and GSM-EFR, currently used in cable/radio communication networks use a CELP type coding method as a fundamental structure. The standard audio encoders are different from one another in their detailed structure.

The CELP encoder is used to extract a distinctive parameter of an audio signal from the first and second transcoders 121 and 122 inside the media gateway 120 shown in FIGS. 6 and 7.

Figure 9:
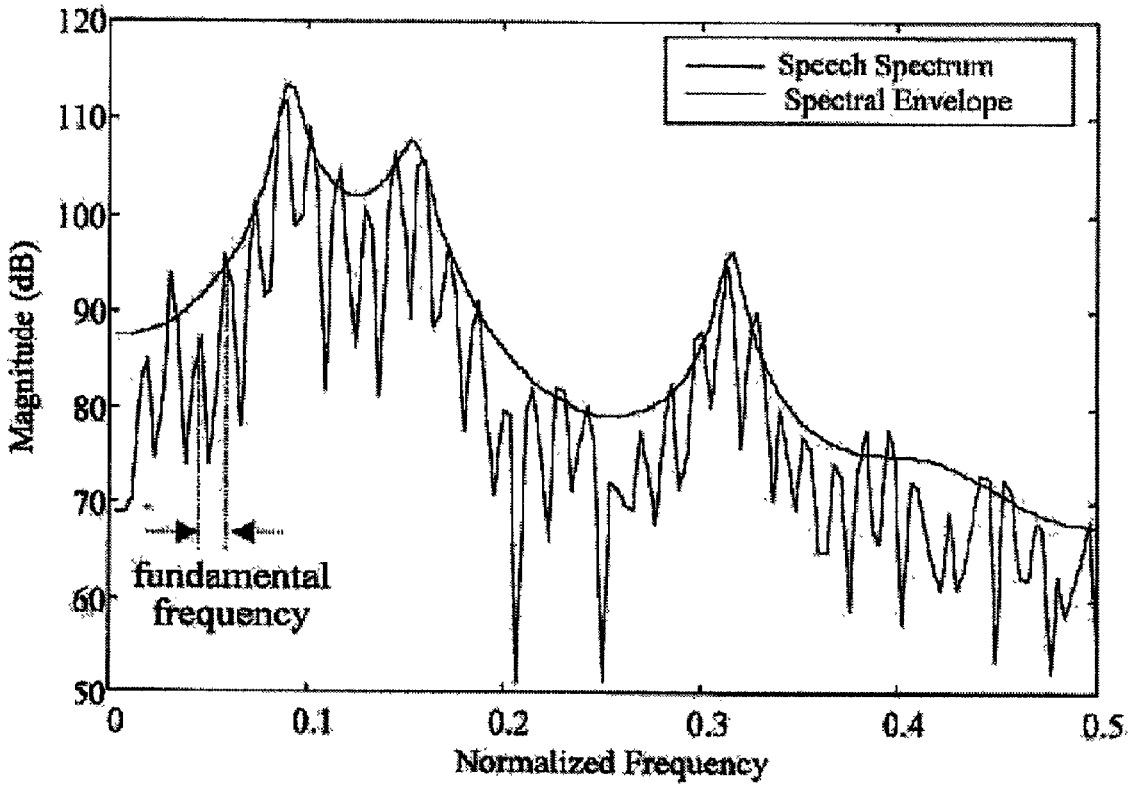
FIG. 9 illustrates an audio spectrum and a distinctive parameter extracted using the CELP audio encoder of FIG. 8.

FIG. 9 illustrates an audio spectrum and a distinctive parameter. The CELP encoder has encoding parameters, such as line spectrum pair (LSP), pitch, Adaptive CodeBook (ACB) gain, ACB index, Fixed CodeBook (FCB) gain, and index.

A spectrum of an audio signal includes three elements, i.e., a spectral envelope, a periodical component (harmonic component of a fundamental frequency), and a non-periodical component (noise component). At this time, the fundamental frequency is expressed as an inverse number of Pitch (W0=1/P). At this time, since a speech spectrum is expressed by combining the periodical component with the non-periodical component, it is shown unevenly.

The CELP encoder predicts a spectrum envelope through the STP step and predicts the periodical component through the LTP step. The CELP encoder also estimates the non-periodical component, which is an estimated error between the STP and LTP steps, through the FCB. The CELP uses LSP as STP parameter, ACB gain and index as LTP parameter, and FCB gain and index as FCB search parameter.

The standard encoders have different encoding parameters in their scale or range, quantization method, and bit allocation according to transmission rate. However, they have the same data information in the encoding parameters. Therefore, in the present invention, the standard encoders efficiently convert audio packet in a parameter region having the same information per the standard encoder.

Figure 10:
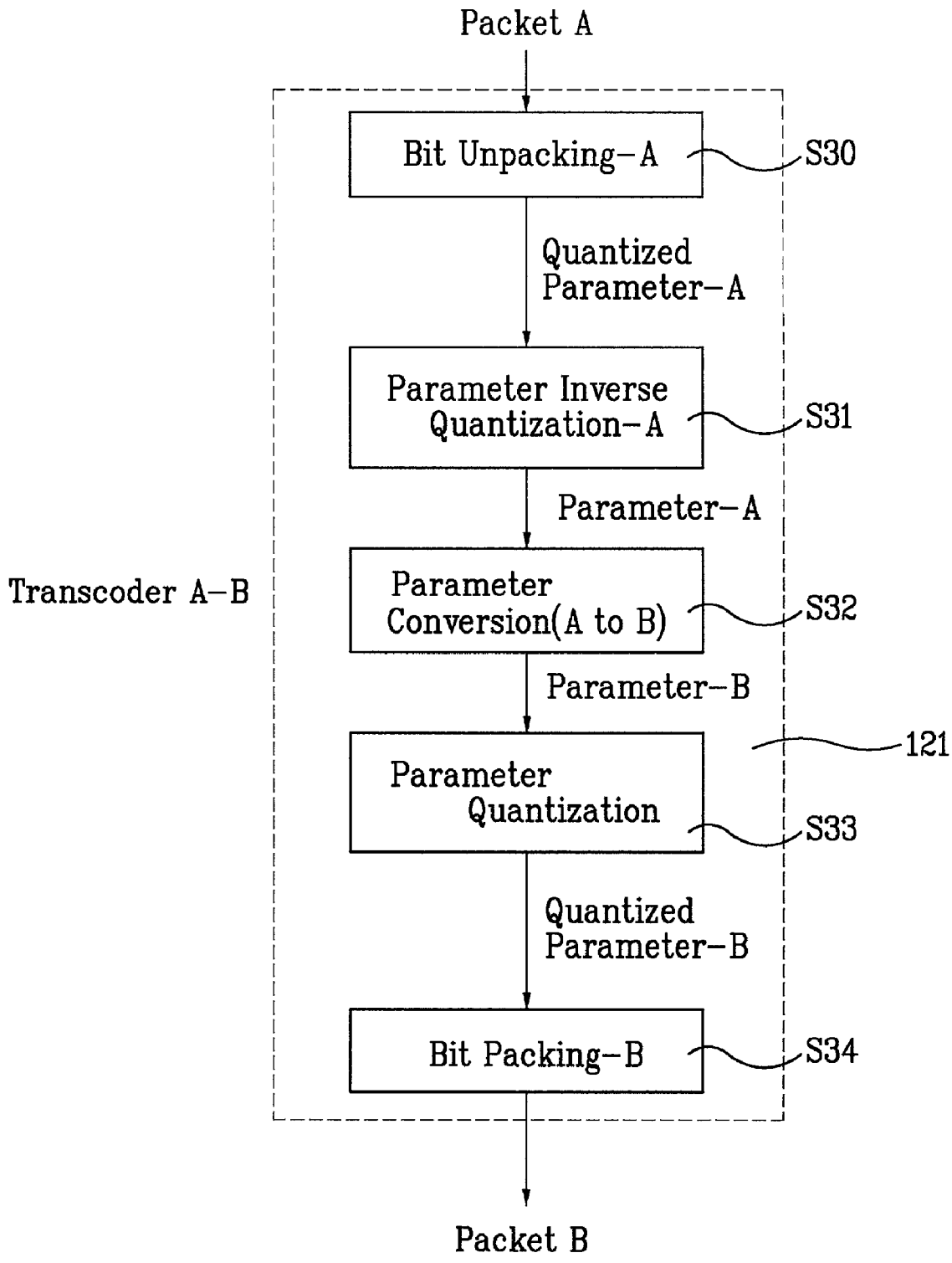
FIGS. 10 and 11 illustrate a packet converting method according to the present invention.
Figure 11:
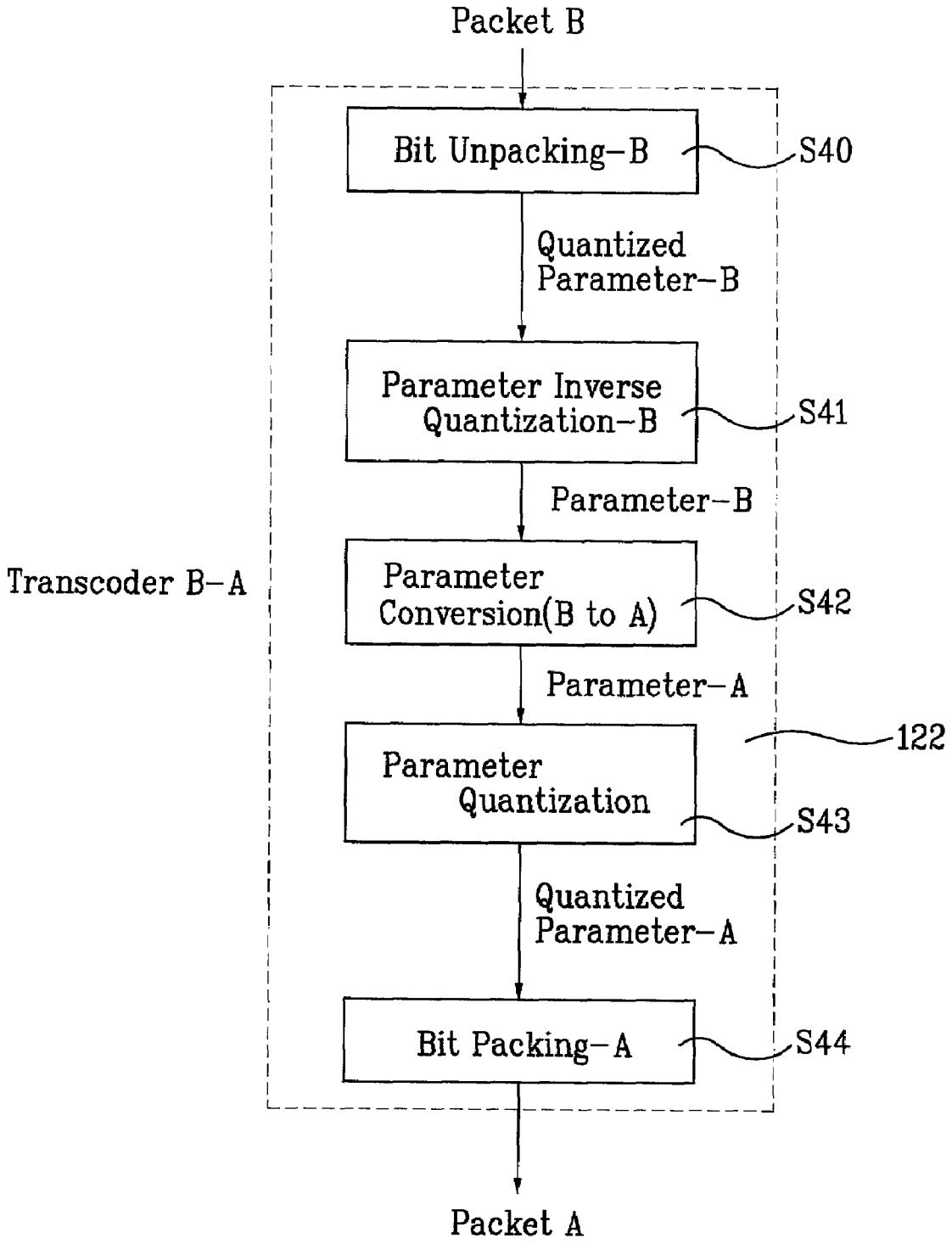

FIGS. 10 and 11 illustrate a packet converting method according to the preferred embodiment of the present invention. Referring to FIG. 10, in the packet converting method based on the packet converting apparatus shown in FIG. 6, the first type packet data Packet-A received in the media gateway 120 is transcoded to the second type packet data Packet-B. The audio packet Packet-A of the first type encoder 80, input through the first network 90, is bit-unpacked in the first transcoder 121 (S30).

Subsequently, the unpacked data is inverse quantized so that an audio parameter is obtained from the first type packet data Packet-A of the first type encoder 80 (S31). The audio parameter of the first type encoder 80 is fast converted to an audio parameter suitable for the second type decoder 110 (S32).

According to the described embodiment, a simple parameter conversion step is used instead of the synthetic step of the audio signal and the complicated parameter analyzing step in the related art. The parameter analyzing step in the related art is to estimate a parameter to have a minimum error. Such a minimum error causes distortion of sound quality and additional delays due to buffering required in the analyzing step. Such additional delay increases echo, thereby deteriorating sound quality.

However, in the parameter direct converting step according to the preferred embodiment of the present invention, either LSP showing the spectrum envelope of the audio signal or pitch showing the tone can reduce distortion of sound quality. Moreover, since direct conversion between parameters without passing through a PCM signal does not cause additional delay, a quantity of calculation is small.

LSP or pitch parameter conversion smoothes the parameters using inter-frame interpolation.

ACB gain or ACB index constrains a search range in a value obtained from the first type packet Packet-A and is fast converted to the second type packet parameter using a fast ACB search algorithm. Furthermore, FCB gain and FCB index of the first type are also converted to the second type packet parameter using a fast FCB search algorithm.

The fast ACB and FCB algorithms can significantly reduce the quantity of calculation while maintaining performance of the related art search algorithm. Then, the second type packet parameter is quantized (S33). Subsequently, the quantized data is bit packed so that the second type audio packet Packet-B is output to the second type decoder 110 through the second network 100 (S34).

Referring to FIG. 11, in the method for converting packet using the packet converting apparatus shown in FIG. 7, the second type packet data Packet-B received in the media gateway 120 is transcoded to the first type packet data Packet-A. The audio packet Packet-B of the second type encoder 130, input through the second network 100, is unpacked in the second transcoder 122 (S40). The unpacked data is then inverse quantized so that an audio parameter is obtained from the second type packet data Packet-B of the second type encoder 110 (S41).

The audio parameter of the second type encoder 130 is fast converted to an audio parameter suitable for the first type decoder 140 (S42). Then, the second type parameter is quantized (S43). The quantized data is bit packed so that the audio packet data Packet-A of the first type is output to the first type decoder 140 through the first network 90 (S44).

Figure 12:
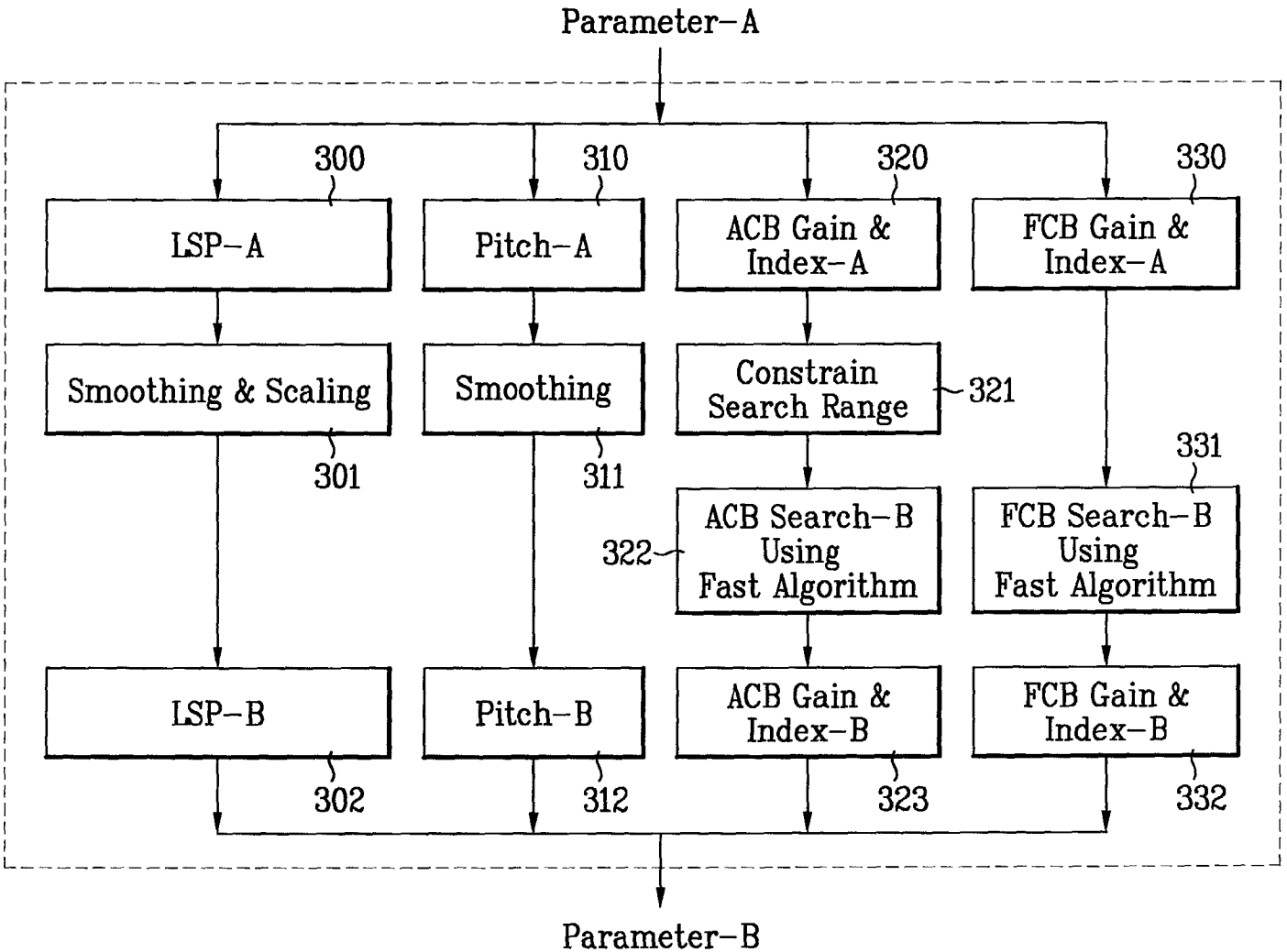
FIGS. 12 and 13 illustrate a parameter converting step used in the packet converting method of FIGS. 10 and 11.
Figure 13:
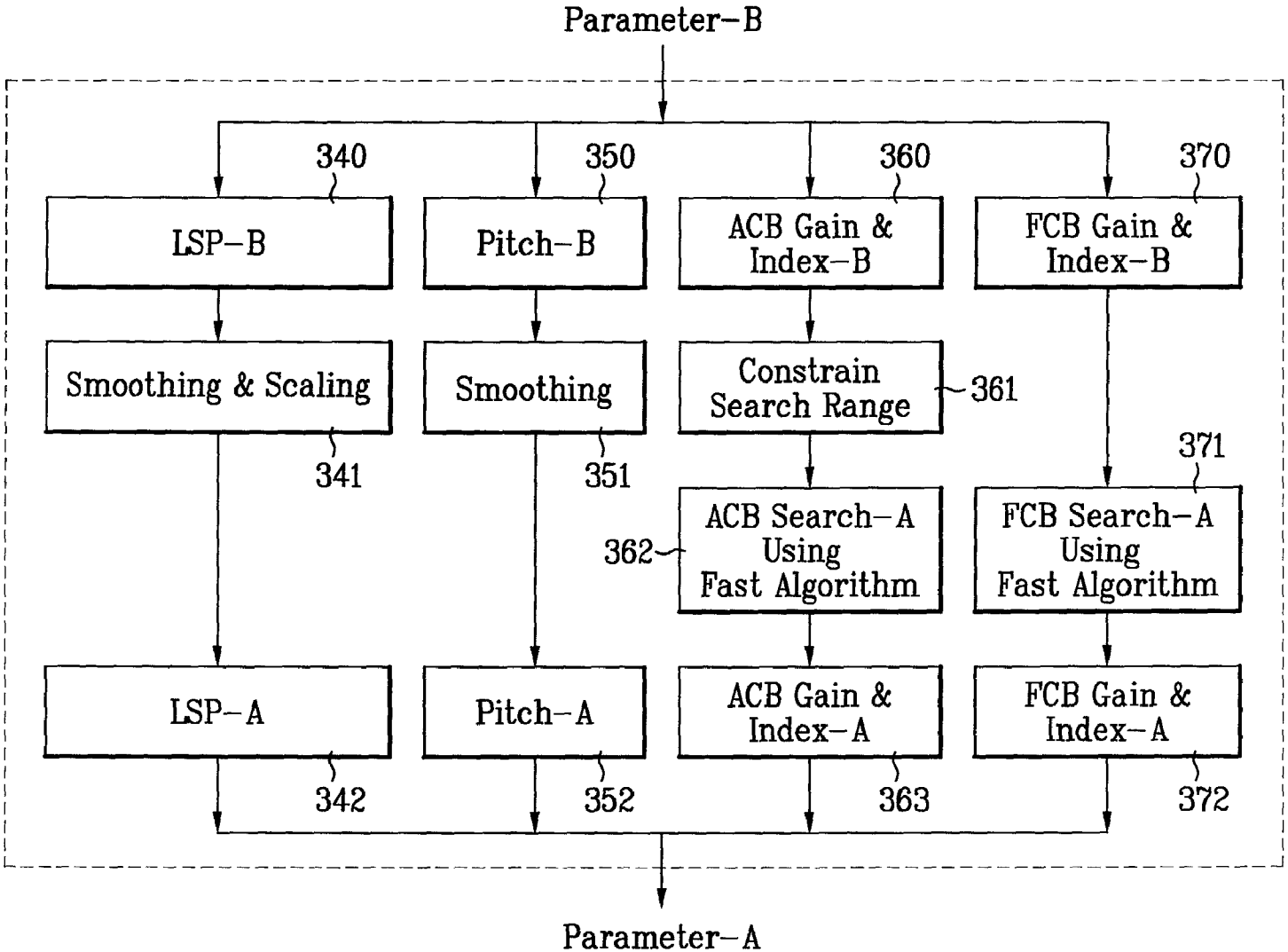

FIGS. 12 and 13 illustrate a parameter converting steps used in the packet for converting method shown in FIGS. 10 and 11. The step (S32) of converting parameter A to parameter B as shown in FIG. 10 will be described in more detail with reference to FIG. 12.

After the audio parameter is obtained from the first type packet Packet-A (S31), LSP (LSP-A) 300 of the first type packet showing the spectrum envelope of the audio signal is smoothed using the inter-frame interpolation so as to convert the audio parameter to an audio parameter suitable for the second type decoder 110 (FIG. 6). The LSP (LSP-A) 300 of the first type packet is scaled (301) and converted to LSP (LSP-B) of the second type packet (302).

Pitch (Pitch-A) 310 of the first type packet showing tone is smoothed using the inter-frame interpolation (311). The Pitch 310 is then converted to Pitch (Pitch-B) of the second type packet without additional process.

The search range is constrained based on the ACB gain and the index-A (first type packet index) which is a pitch component energy (320 and 321). Then, ACB gain & index-B is searched through a fast search algorithm (fast ACB search algorithm) (322), so that the searched value is converted to the ACB gain & index-B (second type packet index) (323).

FCB gain & index-B, which is a spectral envelope, is searched through the fast search algorithm (fast FCB search algorithm), so that the searched value is converted to the FCB gain & index-B (second type packet index) (332).

The step (S42) of converting parameter B to parameter A as shown in FIG. 11 will be described in more detail with reference to FIG. 13. After the audio parameter is obtained from the second type packet Packet-B (S41), LSP (LSP-B) 340 of the second type packet showing a spectrum envelope of the audio signal is smoothed through inter-frame interpolation so as to convert the audio parameter to an audio parameter suitable for the first type decoder 140 shown in FIG. 7. The LSP (LSP-B) 340 of the second type packet is scaled and then is converted to LSP(LSP-A) of the first type packet (341 and 342).

Pitch (Pitch-B) 350 of the second type packet showing tone is smoothed using the inter-frame interpolation (351). The Pitch 350 is then converted to Pitch (Pitch-A) of the first type packet without additional process (352).

The search range is constrained based on the ACB gain and the index-B (second type packet index) 360, which is pitch component energy (361). Then, ACB gain & index-A is searched through the fast search algorithm (fast ACB search algorithm) (362), so that the searched value is converted to the ACB gain & index-A (first type packet index) (363).

The FCB gain & index-B, which is a spectral envelope, is searched through the fast search algorithm (fast FCB search algorithm), so that the searched value is converted to the FCB gain & index-B (second type packet index) (332).

As aforementioned, the packet converting apparatus and the packet converting method using the same according to the present invention have the following advantages.

Different types of the audio encoders are currently used according to purpose of use in an audio communication service based on a mobile communication network and a data communication network (for example, IP network). Accordingly, for mutual communication between the mobile communication network and the data communication network, a packet converting apparatus is required between different audio encoders.

Unlike the related art tandem-coding method, in the present invention, the parameter analyzing step is omitted so that the quantity of calculation can remarkably be reduced. Also, neither memory for analyzing parameters is required, nor additional delay for analyzing parameters occurs.

Therefore, the packet converting method according to the present invention reduces the quantity of calculation by about 40% as compared with the related art and is more efficient in view of memory.

In the media gateway system, since more channels are used with the same resource, it is expected that economical effect will be high.

The preferred embodiments may be implemented as a method, apparatus or article of manufacture using standard programming and/or engineering techniques to produce software, firmware, hardware, or any combination thereof. The term "article of manufacture" as used herein refers to code or logic implemented in hardware logic (e.g., an integrated circuit chip, Field Programmable Gate Array (FPGA), Application Specific Integrated Circuit (ASIC), etc.) or a computer readable medium (e.g., magnetic storage medium (e.g., hard disk drives, floppy disks, tape, etc.), optical storage (CD-ROMs, optical disks, etc.), volatile and non-volatile memory devices (e.g., EEPROMs, ROMs, PROMs, RAMs, DRAMs, SRAMs, firmware, programmable logic, etc.). Code in the computer readable medium is accessed and executed by a processor. The code in which preferred embodiments are implemented may further be accessible through a transmission media or from a file server over a network. In such cases, the article of manufacture in which the code is implemented may comprise a transmission media, such as a network transmission line, wireless transmission media, signals propagating through space, radio waves, infrared signals, etc. Of course, those skilled in the art will recognize that many modifications may be made to this configuration without departing from the scope of the present invention, and that the article of manufacture may comprise any information bearing medium known in the art.

The logic implementation of FIGS. 10 to 13 described specific operations as occurring in a particular order. In alternative implementations, certain of the logic operations may be performed in a different order, modified or removed and still implement preferred embodiments of the present invention. Moreover, steps may be added to the above described logic and still conform to implementations of the invention.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

What is claimed is:

1. A packet converting apparatus for converting a first type packet data to a second type packet data, the packet converting apparatus comprising:

a bit unpacking unit for bit unpacking the first type packet data; a parameter inverse quantization unit for inverse quantizing unpacked data to obtain a first parameter of the first type packet data, wherein the first parameter includes at least one of line spectrum pair, pitch, adaptive codebook (ACB) gain, ACB index, fixed codebook (FCB) gain and FCB index;

a parameter converter for converting the first parameter to a second parameter of the second type packet data using inter-frame interpolation without synthesizing a pulse code modulation (PCM) signal, wherein the inter-frame interpolation in the parameter converter constrains a search range in response to the ACB gain and the ACB index and searches the search range to obtain values corresponding to the ACB gain and the ACB index of the first parameter and converts the values into an ACB gain and an ACB index of the second parameter;

a quantization unit for quantizing the second parameter converted by the parameter converter and outputting a second type quantized data; and a bit packing unit for bit packing the second type quantized data to the second type packet data.

2. The packet converting apparatus of claim 1, further comprising a packet conversion determining unit for detecting a destination packet type of the first type packet data and determining that the first type packet data is converted to the second type packet data.

3. The packet converting apparatus of claim 1, wherein the first type packet data is at least one of audio packet data, video packet data, and audio/video packet data.

4. The packet converting apparatus of claim 1, wherein the second type packet data is at least one of audio packet data, video packet data, and audio/video packet data.

5. The packet converting apparatus of claim 1, wherein the inter-frame interpolation in the parameter converter smoothes and scales the line spectrum pair of the first parameter to obtain a line spectrum pair of the second parameter.

6. The packet converting apparatus of claim 1, wherein the inter-frame interpolation in the parameter converter smoothes the pitch of the first parameter to obtain a pitch of the second parameter.

7. The packet converting apparatus of claim 1, wherein the inter-frame interpolation in the parameter converter searches to obtain values corresponding to the FCB gain and the FCB index of the first parameter and converts the values into an FCB gain and an FCB index of the second parameter.

8. A media gateway for communicating between a first communication network using a first type packet data and a second communication network using a second type packet data, the media gateway comprising:

at least one transcoder connected between the first and the second communication network, each transcoder comprising:

a parameter converter for converting a first parameter of the first type packet data to a second parameter of the second type packet data using inter-frame interpolation without synthesizing a pulse code modulation (PCM) signal, wherein the first and the second parameters include at least one of line spectrum pair, pitch, adaptive codebook (ACB) gain, ACB index, fixed codebook (FCB) gain and FCB index, and wherein the inter-frame interpolation in the parameter converter constrains a search range in response to the ACB gain and the ACB index and searches the search range to obtain values corresponding to the ACB gain and the ACB index of the first parameter and converts the values into an ACB gain and an ACB index of the second parameter.

9. The media gateway of claim 8, wherein the transcoder further comprises:

a bit unpacking unit for bit unpacking the first type packet data;

a parameter inverse quantization unit for inverse quantizing unpacked data to obtain a first parameter of the first type packet data;

a quantization unit for quantizing the second parameter converted by the parameter converter and outputting a second type quantized data; and a bit packing unit for bit packing the second type quantized data to the second type packet data.

10. The media gateway of claim 8, wherein the inter-frame interpolation in the parameter converter smoothes and scales the line spectrum pair of the first parameter to obtain a line spectrum pair of the second parameter.

11. The media gateway of claim 8, wherein the inter-frame interpolation in the parameter converter smoothes the pitch of the first parameter to obtain a pitch of the second parameter.

12. The media gateway of claim 8, wherein the inter-frame interpolation in the parameter converter searches to obtain values corresponding to the FCB gain and the FCB index of the first parameter and converts the values into an FCB gain and an FCB index of the second parameter.

13. A method for converting a first type packet data to a second type packet data, comprising the steps of:

bit unpacking the first type packet data;

inverse quantizing unpacked data to obtain a first parameter of the first type packet data, wherein the first parameter includes at least one of a line spectrum pair, pitch, adaptive codebook (ACB) gain, ACB index, fixed codebook (FCB) gain and FCB index;

converting the first parameter to a second parameter of the second type packet data using inter-frame interpolation without synthesizing a pulse code modulation (PCM) signal, wherein inter-frame interpolation includes constraining a search range in response to the ACB gain and the ACB index and searching the search range to obtain values corresponding to the ACB gain and the ACB index of the first parameter and converting the values into an ACB gain and an ACB index of the second parameter;

quantizing the second parameter and outputting a second type quantized data; and bit packing the second type quantized data to the second type packet data.

14. The method of claim 13, wherein the first type packet data is at least one of audio packet data, video packet data, and audio/video packet data.

15. The method of claim 13, wherein the second type packet data is at least one of audio packet data, video packet data, and audio/video packet data.

16. The method of claim 13, wherein the step of inter-frame interpolation includes smoothing and scaling the line spectrum pair of the first parameter to obtain a line spectrum pair of the second parameter.

17. The method of claim 13, wherein the step of inter-frame interpolation includes smoothing the pitch of the first parameter to obtain a pitch of the second parameter.

18. The method of claim 13, wherein the step of inter-frame interpolation includes searching to obtain values corresponding to the FCB gain and the FCB index of the first parameter and converting the values into an FCB gain and an FCB index of the second parameter.

* * * * *